US005410958A

United States Patent [19]

Sharpe

[11] Patent Number: 5,410,958

[45] Date of Patent: May 2, 1995

[54] FABRIC PRINTING PROCESS AND APPARATUS

[76] Inventor: Gary D. Sharpe, 2235 Breckenridge Dr., Lawrence, Kans. 66047

[21] Appl. No.: 86,174

[22] Filed: Jun. 25, 1993

[51] Int. Cl.[6] ..... B41M 1/10

[52] U.S. Cl. ..... 101/170; 101/129; 101/211; 101/407.1; 101/474

[58] Field of Search ..... 101/129, 170, 211, 407.1, 101/474; 427/282, 290; 2/144, 146

[56] References Cited

U.S. PATENT DOCUMENTS

| | | | |
|---|---|---|---|
| 2,400,700 | 5/1946 | McCurrach | 2/146 |
| 4,423,676 | 1/1984 | Neel | 101/116 |
| 4,708,057 | 11/1987 | Hogenson | 101/129 |
| 5,174,202 | 12/1992 | Schlichting | 101/129 |

*Primary Examiner*—Edgar S. Burr
*Assistant Examiner*—Lynn D. Hendrickson
*Attorney, Agent, or Firm*—Shook, Hardy & Bacon

[57] ABSTRACT

A process is provided for printing fabric, including fabric used in the making ties and other clothing articles. The process includes the step of stabilizing the fabric so that it can be subjected to printing processes without the degree of fabric deformation that would otherwise take place. A backing sheet of kraft paper or other suitable material is used to stabilize the fabric. In one embodiment, the fabric is stabilized so that it can be pulled through a lithographic printing apparatus. Alternatively, the stabilized fabric can be subjected to screen printing processes. The invention is also directed to the stabilized fabric.

12 Claims, 1 Drawing Sheet

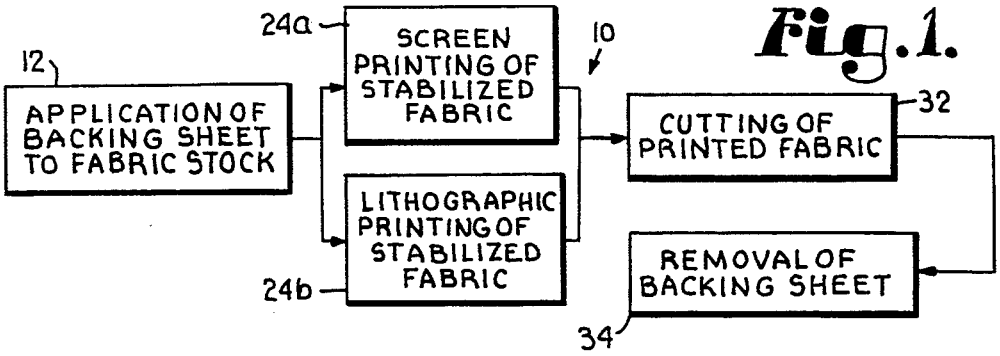
Fig.1.
Fig.2.
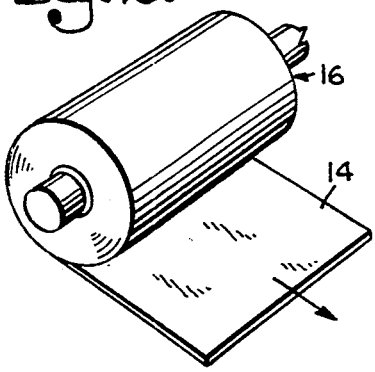
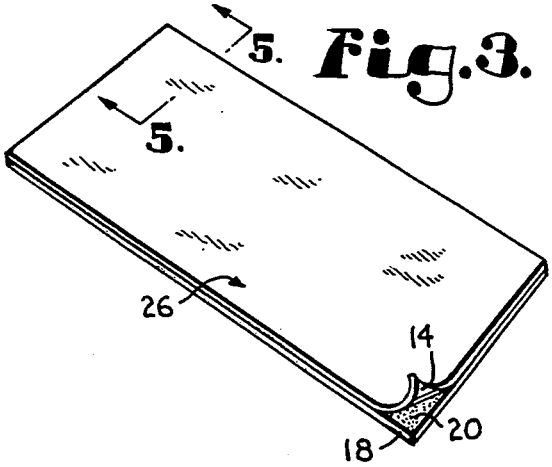
Fig.3.
Fig.4.
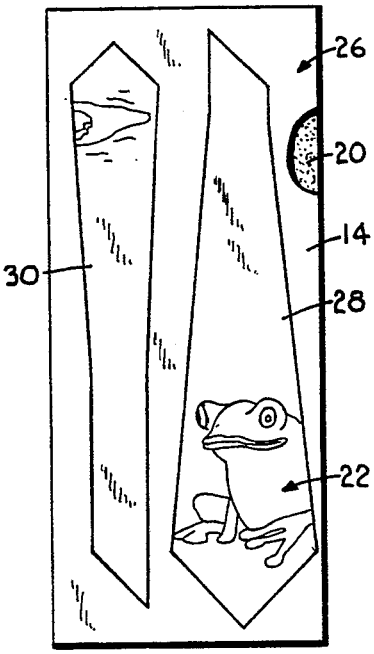
Fig.5.
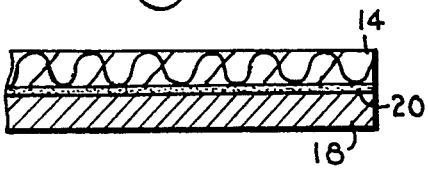
Fig.6.
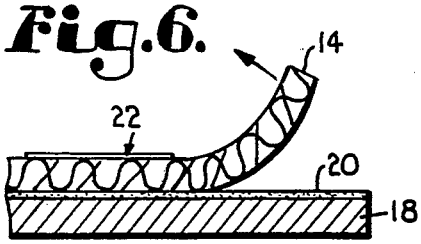

FABRIC PRINTING PROCESS AND APPARATUS

BACKGROUND OF THE INVENTION

This invention relates in general to fabric printing processes and, more particularly, to processes and apparatus for lithographic and screen printing of fabrics.

Screen printing processes are widely used to print patterns on fabrics used in the manufacture of ties and other wearing apparel. In such processes, colored inks are applied to the fabric through individual framed screens which are made of mesh material and have been prepared in a manner to allow the ink to pass through only those portions of the screen which correspond to the desired pattern. A squeegee or pressurized plenum is typically used to force the inks through the screens and onto the underlying fabric substrate. In order to obtain a multi-colored design, a different color ink is used for each screen and the screens are typically mounted to move in relation to an underlying platen on which the fabric substrate is applied. Because individual portions of the multi-colored design are applied sequentially using multiple screens, great care must be exercised to ensure that each screen is precisely aligned over the fabric substrate during application of the ink to the fabric.

Although it is often desirable to include a large number of colors in a pattern applied to fabrics using screen printing methods, the preparation and use of multiple screens is labor intensive and substantially increases the cost of the printed article. In an effort to reduce screen printing costs while still providing for a range of printed colors, a screen printing process has been developed which utilizes combinations of four base colors, such as black, magenta, yellow and cyan, to achieve the desired color. In general, multiple colors are obtained in this four color process by overlaying one or more base colors over another base color on the substrate, e.g. applying the cyan color over the color yellow will produce a green hue and adding magenta will produce a brown hue.

In order to achieve the desired color pattern in a four color screen printing process, each of the four screens is prepared in a manner so that it will produce a pattern of small ink dots of one of the base colors. One base color of ink is then applied to the fabric substrate through the first screen, with the other base colors being applied successively through the other screens. The sharpness of the resulting image is dictated not only by the alignment or registration of the screens and the type of fabric utilized, but also by the size and spacing of the ink dots.

A primary advantage to the four color printing process is that only four screens are needed to produce the desired pattern. As a result, labor and cost savings are achieved in the preparation of the screens because fewer screens are prepared in comparison to other conventional processes in which up to fifteen screens may be utilized. In addition, the four color process is less labor intensive during the printing process because the inks are applied through only four screens. However, one disadvantage resulting from this process is that exact alignment or registration of each of the four screens is required in order to produce a sharp image. If any one of the screens is slightly misaligned during the ink transfer process, the colors will "bleed" as ink dots are shifted from their intended alignment. This problem becomes even more pronounced in those instances where smaller ink dots are used to obtain sharper images. As a result, the number of dots per inch used in four color screen printing processes and the clarity of the resulting image must often be less than would otherwise be desired.

Another problem associated with screen printing processes, and four color processes in particular, is the color variation that frequently occurs as the ink permeability through the screens changes. The changes in ink permeability can result from a number of factors such as dried ink plugging portions of the screens and variations in the force applied by the squeegee or pressure plenum. While minor color changes can often be tolerated in most production runs, even subtle color variations can significantly detract from the appearance and value of certain articles such as piece goods which are subsequently sewn together to form a finished product.

The inability to precisely align successive fabric substrates during screen printing processes also lessens the production rates that can be achieved in some instances. The alignment difficulties can often be traced to the tendency of certain fabrics to elastically contract, such as when sheets of fabric are cut from large rolls of fabric. Silk is one material which is particularly prone to such movement or warping when it is handled. If the fabric movement occurs prior to printing then the printed image will be distorted. In addition, because the printed patterns are often cut at the same time from multiple sheets of fabric which are stacked together, alignment problems may also result if the fabric moves after printing but prior to cutting of the printed pattern. Even a slight misalignment during the cutting process may adversely affect the appearance and value of the finished product.

Although the use of larger sheets of fabric can reduce the movement of materials such as silk in screen printing processes, the screens used to print the fabric are typically available in a limited number of standard sizes. A significant need thus exists for a method of stabilizing fabrics such as silk so that existing screens can be utilized and still produce the desired high quality printed products.

Four color printing is also commonly used in a type of printing known as lithographic printing. In lithographic printing machines, plates which are typically made of aluminum are wrapped around rotatable cylinders. The plates have been etched in a manner which causes the ink to be retained on only the desired portions of the plate. As a substrate such as paper is fed through the machine, it contacts successive plates which transfer the colored ink dot patterns onto the paper to form the desired multicolored image. Because of the ability to exactly align suitable substrates in lithographic printers, the number of dots per inch which can be used often greatly exceeds that which can be obtained using screen printing processes.

Although internal alignment mechanisms are utilized in lithographic printing machines in order to assist in the alignment of the substrate as it is pulled through the machine, the substrate must possess a certain minimum degree of stiffness and resistance to deformation in order to be properly aligned and to maintain the desired alignment during the printing process. Many types of fabrics, including silk, are generally unsuited for conventional lithographic printing processes because they lack the physical characteristics needed to ensure proper alignment or registration. Thus, while lithographic printing is generally faster and can produce a sharper and more readily reproducible image in comparison to screen printing, lithographic printing remains unsuited for use with many types of fabrics.

SUMMARY OF THE INVENTION

It is an object of this invention to provide a process for stabilizing fabrics such as silk so that the fabric has sufficient stiffness to allow it to be pulled through a lithographic printing machine while it is maintained in the desired alignment, thereby allowing the lithographic printing process to be used to print patterns on those fabrics previously thought to be poorly suited for such a process.

It is also an object of this invention to provide a process for stabilizing fabrics to reduce the incidence of elastic constriction of the fabrics during handling, printing and cutting of the fabrics so that a sharper and more accurately aligned pattern may be printed on the fabrics.

It is another object of this invention to provide a stabilized fabric which can be more easily aligned during printing of a pattern or image on the fabric so that a higher quality image can be produced on the fabric.

It is a yet another object of this invention to provide a stabilized fabric which has sufficient stiffness and resistance to deformation to allow a pattern or image to be printed on the fabric at a specific position so that portions of the fabric containing the printed image can be precisely cut out either by stacking multiple fabric sheets and cutting them together or by using a die cutter to cut individual fabric sheets at a high production rate.

It is a further object of this invention to provide a stabilized fabric and a process for printing same which allows for the use of four color printing processes to more accurately and rapidly produce high quality printed patterns with less material waste resulting from poorly applied or misaligned patterns.

To attain these and other related objects, in one aspect the invention is related to a stabilized fabric comprising: a sheet of textile material; and a backing sheet releasably applied to the sheet of textile material, said backing sheet characterized by having a tensile strength greater than that of the sheet of textile material.

In another aspect the invention is directed to a printing process comprising the steps of: providing a fabric material; providing a backing sheet and releasably applying the backing sheet to the fabric material to stabilize the fabric material by increasing the resistance of the fabric material to deformation along an axis lying in a plane defined by the fabric material; and printing a multi-colored pattern on a side of the fabric material opposite from the backing sheet. In one embodiment, the printing may be accomplished using lithographic processes. In another embodiment, screen printing processes may be used.

Although the invention has particular applicability in the printing of neckties on silk, it will be appreciated that other articles and materials such as tissue paper are well suited for stabilization and printing in accordance with the present invention.

A primary advantage attained by one aspect of the present invention is the ability to use lithographic printing process to produce sharp multi-colored images at high production rates on those fabrics, such as silk, which have previously been unsuited for such a printing process because of the delicate nature of the fabrics. Thus, in addition to a substantial reduction in labor and materials costs in the printing process, the quality of the final printed product can be greatly improved.

Another advantage of the present invention is the ability of the stabilized fabric to be used with smaller sized screens in four color screen printing processes and still obtain the desired image sharpness.

Notably, the images printed on the fabrics can be more precisely registered because of the increased stability of the fabrics, thereby allowing the fabric portion containing the printed image to be more accurately cut out at high production rates using die cutting techniques which were previously unsuitable because of the variations in the positioning of the images on individual sheets.

BRIEF DESCRIPTION OF THE DRAWINGS

In the accompanying drawings which form a part of the specification and are to be read in conjunction therewith and in which like reference numerals are used to indicate like parts in the various views:

FIG. 1 is a block diagram illustrating the fabric stabilization and printing processes of the present invention which can be used to stabilize and print fabrics such as clothing articles;

FIG. 2 is a perspective view of a rolled supply of fabric material;

FIG. 3 is a perspective view of a pre-cut sheet of the fabric material applied to a backing sheet which stabilizes the fabric material;

FIG. 4 is a top plan view of the sheet of fabric material after it has been printed with a pattern which can be used to make a necktie, a portion of the fabric material being broken away to show the underlying backing sheet;

FIG. 5 is a fragmentary side elevation view of the sheet of fabric material and backing sheet taken in horizontal section along line 5—5 of FIG. 3 in the direction of the arrows, the view being taken on a greatly enlarged scale to illustrate the positioning of an adhesive between the fabric material and the backing sheet; and FIG. 6 is a fragmentary side elevation view of the sheet of fabric material and backing sheet after the pattern has been printed on the fabric material, the view being similar to that shown in FIG. 5 but illustrating the removal of the fabric material from the backing sheet with the adhesive being retained on the backing sheet.

DESCRIPTION OF THE PREFERRED EMBODIMENTS

Referring now to the drawings in greater detail, and initially to FIG. 1, a process in accordance with the present invention for stabilizing and printing fabrics is represented generally by the numeral 10. Process 10 can be utilized with many types of fabrics such as silk, polyester, cotton, linen and rayon. Included within the definition of fabrics are paper products such as tissue paper and toilet paper. The process 10 is particularly suited for stabilizing and printing fabrics which are susceptible to being torn or deformed during the printing process. Notably, the process 10 of the present invention allows for more accurate printing of fabrics by ensuring that the fabric is stiff enough to remain in the desired alignment during the printing process. In addition, process 10 allows fabrics such as silk to be printed using methods, such as lithographic printing, which were previously unsuited for use with such fabrics because of the delicate nature of the material and the inability of the fabric to maintain the desired positioning during handling.

Process 10 comprises the step designated by the numeral 12 of supplying a stock of fabric material 14 such as fabric provided on roll 16 as shown in FIG. 2 and then stabilizing the fabric material by apply a backing sheet 18 to one face or side of the fabric material 14 as shown in FIG. 3. The backing sheet 18 can comprise any suitable material having the necessary physical properties. The tensile strength of the backing sheet 18 must be sufficient to provide the desired stiffening of the fabric material 14. The backing sheet 18 tensile strength must normally exceed that of the fabric material 14 in order to allow the fabric material to be processed in the desired manner. In some instances, however, sufficient stiffening can be provided even if the backing sheet 18 has a lesser tensile strength than the fabric material. Although the tensile strength of the backing sheet 18 will normally be uniform in all directions, it is important that the backing sheet 18 possess the necessary tensile strength in a direction corresponding to the direction of greatest stress on the fabric material 14 during the printing process. Normally, this direction will coincide with the axis along which the fabric material 14 travels during the printing process.

The backing sheet 18 should desirable be formed of an inexpensive material such as any of various paper products. In one embodiment the backing sheet 18 is formed from Kraft paper.

The backing sheet 18 can be supplied in roll form for convenience in storage and handling, although flat sheets of material could be provided instead. Likewise, the fabric material 14 can be in roll form as illustrated or can be provided in flat sheets. The backing sheet 18 is applied to the fabric material 14 using a suitable adhesive 20 as shown in FIG. 5. The adhesive 20 should be compatible with the fabric material 14 and should have a sufficient tackiness to prevent shifting of the fabric material 14 on the backing sheet 18 during normal handling procedures. The tackiness of the adhesive 20, however, should not be such that the fabric is damaged during removal of the adhesive 20 from the fabric material. The adhesive 20 should be easily removable from the fabric material 14 and is preferably retained on the backing sheet 18 so that the backing sheet 18 and adhesive 20 can be easily removed together from the fabric material 14, as illustrated in FIG. 6. In one embodiment, a suitable adhesive 20 is provided by the use of 3M brand Spray Mount Artist's Adhesive which is sprayed onto Kraft paper. It will be appreciated, however, that other types of adhesives 20 and backing sheets 18 may be used and may by preferred for use in commercial operations.

Returning to FIG. 1, the next step of the process 10 comprises the step of printing of the desired pattern 22, such as shown in FIG. 4, onto the fabric material 14 which has been stabilized by the application of the backing sheet 18. Notably, the printing process can be a screen printing process **24*a* or a lithographic printing process 24*b* and is preferably, but not necessarily, a four color process. When a screen printing process is used, the stabilized fabric material 14, including backing sheet 18, is applied to a platen and the pattern 22 is applied in a well known manner which need not be described in detail herein. When a lithographic printing process is used, the stabilized fabric material 14 and backing sheet 18** are simply feed through a suitable lithographic printing apparatus.

The printing step **24*a* or 24*b* can also include the step of cutting the stabilized fabric material 14 and backing sheet 18 into the appropriately sized sheet 26 (FIG. 3). Alternatively, it will be appreciated that the fabric material 14** and backing sheets could be cut to the appropriate sizes prior to application of the backing sheet to the fabric material.

During the printing step **24*a* or 24*b*, the printed pattern 22 is positioned on the surface of the fabric material 14 opposite from backing sheet 18. As illustrated in FIG. 4, the printed pattern 22 comprises two pieces 28 and 30 which can be cut from the sheet 26** and sewn together to form a necktie. It will be appreciated that various other patterns could be utilized to form different types of clothing articles or non-clothing articles such as tissue paper and toilet paper.

Once the pattern 22 has dried sufficiently, a cutting step 32 may be performed if necessary to remove the pattern 22 from sheet 26. Notably, because the stabilized fabric material 14 allows the pattern to be accurately aligned on the sheet 26, the cutting step 32 can be performed at a high production rate using a die cutter. The sheets 26 can be individually fed through the die cutter or they can be stacked together so that a number of them can be cut at the same time.

The process 10 also includes the step designated by numeral 34 of removing the backing sheet 18 from the fabric material 14 following the printing of pattern 22. In most instances, the backing sheet 18 will be removed following the cutting step 32, although in some instances the backing sheet 18 can be removed prior to such cutting step. In those instances where no cutting step 32 is performed, the backing removal step 34 will follow printing step **24*a* or 24*b***.

It can thus be appreciated that the process 10 is particularly advantageous in that it allows fabric materials 14 such as silk to be sufficient stabilized so that the fabric can withstand the rigors of lithographic printing, thus allowing the advantages attendant to lithographic printing to be achieved using fabrics which have previously been unsuitable for such printing methods. In particular, the lithographic printing process allows four color printing to be utilized at high production rates and with exceedingly sharp image quality.

The process 10 can also be utilized to print fabric material 14 using screen printing techniques but achieving better quality images. This not only increases the appearance and value of the finished product, but also significantly reduces the labor and material costs.

Because the fabric material 14 is stabilized against internal movement or warping, different colors of ink can be precisely applied to the fabric material to form the composite pattern 22. The process 10 thus lends itself to the use of four color processing and the cost and labor savings attendant thereto.

Using either printing method, the process 10 also allows higher speed cutting of the printed image or pattern 22 because the pattern can be precisely located on the sheet 26. The precise positioning of the pattern 22 allows the cutting to take place on a repetitive basis without having to visually observe the placement of the pattern. Thus, automated cutting techniques can be used in place of manual techniques that are labor intensive and require the operator to observe and align each pattern 22 which is to be cut.

From the foregoing, it will be seen that this invention is one well adapted to attain all the ends and objects hereinabove set forth together with other advantages which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, what is claimed is:

1. A process comprising the steps of:

providing a fabric material which is subject to deformation along an axis lying in a plane defined by the fabric material;

providing a backing sheet and releasably applying the backing sheet to the fabric material to stabilize the fabric material by increasing the resistance of the fabric material to deformation along the axis lying in a plane defined by the fabric material;

feeding the fabric material and backing sheet through a lithographic printing apparatus in the direction of said axis to print a multi-colored pattern on a side of the fabric material opposite from the backing sheet lithographic printing apparatus having printing plates wrapped around rotating cylinders; and cutting the fabric material following said step of printing a multi-colored pattern on the fabric material.

2. The process as set forth in claim 1, including the step of removing the backing sheet from the fabric material following said step of printing a multi-colored pattern on the fabric material.

3. The process as set forth in claim 2, wherein the step of cutting the fabric material comprises cutting the fabric material and backing sheet following said step of printing a multi-colored pattern on the fabric material and prior to said step of removing the backing sheet from the fabric material.

4. The process as set forth in claim 2, wherein the step of cutting the fabric material occurs following said step of removing the backing sheet from the fabric material.

5. A process for printing and cutting fabric for use in making ties, said process comprising the steps of:

supplying a fabric material which is subject to deformation along an axis lying in a plane defined by the fabric material;

releasably applying a backing sheet to the fabric material to stabilize the fabric material by increasing the resistance of the fabric material to deformation along the axis lying in a plane defined by the fabric material;

feeding the fabric material and backing sheet through a lithographic printing apparatus in the direction of said axis, said lithographic printing apparatus having printing plates wrapped around rotating cylinders;

printing a multi-colored pattern on a side of the fabric material opposite from the backing sheet as the fabric material is fed through the lithographic printing apparatus; and cutting a tie portion containing the multi-colored pattern from the fabric material.

6. The process as set forth in claim 5, including the step of removing the backing sheet from the tie portion prior to or after said step of cutting the tie portion.

7. The process as set forth in claim 5, wherein said step of supplying a fabric material comprises the step of supplying silk material.

8. The process as set forth in claim 6, including the step of pre-cutting said fabric material and backing sheet into a blank sized for containing the tie portion, said pre-cutting step occurring prior to said printing step.

9. A process for printing and cutting fabric material for use in making clothing articles, said process comprising the steps of:

supplying a fabric material which is subject to deformation along an axis lying in a plane defined by the fabric material;

releasably applying a backing sheet to the fabric material to stabilize the fabric material by increasing the resistance of the fabric material to deformation along the axis lying in a plane defined by the fabric material;

feeding the fabric material and backing sheet through a lithographic printing apparatus in the direction of said axis said lithographic printing apparatus having printing plates wrapped around rotating cylinders;

printing a multi-colored pattern on a side of the fabric material opposite from the backing sheet as the fabric material is fed through the lithographic printing apparatus; and cutting a clothing article containing the multicolored pattern from the fabric material.

10. The process as set forth in claim 9, including the step of removing the backing sheet from the clothing article prior to or following said step of cutting the clothing article.

11. The process as set forth in claim 9, including the step of pre-cutting said fabric material and backing sheet into a blank sized for containing the clothing article, said pre-cutting step occurring prior to said printing step.

12. The process as set forth in claim 9, wherein said printing step comprises the step of printing the multicolored pattern using a four color process.

* * * * *